US005105872A

United States Patent [19]

Whiddon

[11] Patent Number: 5,105,872

[45] Date of Patent: Apr. 21, 1992

[54] METHOD FOR THE REGIONAL INFILTRATION OF POWDERED METAL PARTS

[75] Inventor: Richard Whiddon, Simpsonville, S.C.

[73] Assignee: Reliance Electric Industrial Company, Greenville, S.C.

[21] Appl. No.: 601,254

[22] Filed: Oct. 19, 1990

[51] Int. Cl.[5] ..... B22D 19/02

[52] U.S. Cl. ..... 164/80; 164/97

[58] Field of Search ..... 164/80, 98, 95, 97; 419/27

[56] References Cited

U.S. PATENT DOCUMENTS 4,033,400 7/1977 Gurnell et al. ..... 164/120
4,172,719 10/1979 McGee et al. ..... 75/200
4,863,538 9/1989 Deckard ..... 264/58

OTHER PUBLICATIONS

*Metals Handbook*, 9th ed., vol. 7, ASM, 1984, "Infiltration".

*Primary Examiner*—Richard K. Seidel
*Attorney, Agent, or Firm*—Dority & Manning

[57] ABSTRACT

A method is disclosed as an improvement to the art of treating local areas of powdered metal parts which have been afflicted with stress concentrations due to applied loads, or have produced adverse frictional characteristics caused by sliding or rolling wear, etc. The method is directed to improving the material properties of these localized areas by placing a suitable metal adjacent the affected area and to apply heat in concentrated form solely upon the metal and the area to affect infiltration of the metal at that area.

16 Claims, 2 Drawing Sheets

METHOD FOR THE REGIONAL INFILTRATION OF POWDERED METAL PARTS

BACKGROUND OF THE INVENTION

This invention relates to a method for improving material properties of powdered metal parts and, in particular, for producing improvements only at selected surfaces of the parts.

It is well known in the use of powdered metal parts that certain local regions experience stress concentration due to loading and geometry of the parts. It is also generally known that adverse frictional consequences are produced by the sliding wear of parts, or by rolling, or by touching of parts. Stresses are higher at points of applied loads and adversely affect frictional wear characteristics of the parts, in particular, at these localized areas. In addition, localized areas may also be weakened due to manufacturing processes which produce powdered metal parts. In order to improve the material properties between these parts as a result of the causes mentioned, it is customary in the art to heat the entire powdered metal part and to melt metallic material over the entire part thereby producing infiltration of the metallic material within the structure of the part.

This complete envelopment of the powdered metal parts with the metallic material is not only expensive in relation to the amount of metallic material which must be dispensed during this procedure, but also, most of the metal parts are affected by infiltrated material which serve no purpose to the parts. In other words, where it is desired to improve material properties of powdered metal parts in certain local areas only, the entire part is generally affected by the process to improve only a very small localized region thereon.

The present invention has been devised in order to overcome the disadvantages mentioned above by producing local infiltration of infiltrant material directly on the area of the powdered material part which is to be improved. This allows the improvement to effect critical areas without the added expense of the infiltrant required to permeate the entire powdered metal part.

Therefore, it is the principal object of the present invention to produce infiltration of infiltrant material directly on the area which is to be improved.

Another object of the invention is to improve material properties at localized areas due to stress concentrations produced by loading applied to those areas.

Another object of the invention is to improve the material properties of powdered metal parts by a method which is not only economical but also requires a minimum of parts and expenditure of effort.

In order to overcome the difficulties mentioned above and to achieve the objects, the present invention was devised whereby the infiltrant material in the form of a metallic substance is applied solely to the area on the powdered metal which is to be improved by infiltration. While the infiltrant is adjacent the area to be infiltrated, heat in concentrated form, is applied to the infiltrant material and only to this target area. This concentrated heat will produce melting of the infiltrant material for effecting infiltration into the powdered metal part. Since only a local area of the powdered metal part is heated, infiltration will be limited solely to that locally heated area. The concentrated form of heat may be provided by a laser system comprising a device for producing a laser beam arranged for sweeping a light ray repeatedly across the infiltrant material. A controller may be utilized to control the amplitude and period of sweeping the beam, the time in which the beam is to be effective against the material and the amount of power for controlling the temperature. In this manner, the volume of infiltration is accurately controlled to the amount necessary to effect the improvement desired in the material property. In another embodiment, an induction coil is utilized for providing heat in concentrated form upon the infiltrant material. A controller is operatively associated with the coil for varying the current and therefore the temperature produced by the coil, and the time of current application, thereby controlling the extent of the depth of infiltration.

These and other objects of the invention will become apparent after reading the following specification taken in conjunction with the drawings wherein.

DESCRIPTION OF A PREFERRED EMBODIMENT

Figure 1:
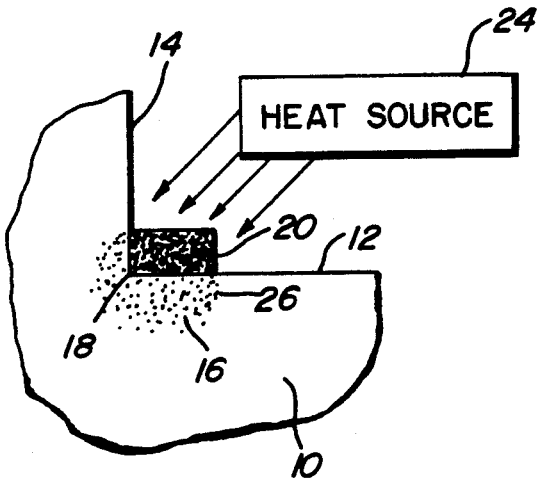
FIG. 1 is a fragmentary schematic illustration of the application of concentrated heat upon an infiltrant material applied to two intersecting surfaces of a powdered metal part.

As shown in FIG. 1, the present invention is applicable to a powdered metal part indicated by reference numeral 10, formed with a step defined by two intersecting sides 12 and 14. Typically, a part 10 having a step or inside corner formation may be a bushing or a shaft having two or more diameters.

Assuming that loading imposed upon the part 10 has produced a stress concentration in the local area indicated by the reference numeral 16, it has been determined that the part 10 will require an improvement to the material properties of that area. It is noted that there is stress concentration at the corner bounded by the sides 12, 14. In accordance with the present invention, an infiltrant material 20 is supplied to the corner 18 in order to improve the material properties thereat.

After the material has been properly applied to the localized area of stress concentration, a heat source 24 is directly applied to the material 20. The heat produced by the source 24 is directed to the material 20 and the area 16, and is of sufficient temperature to melt the infiltrant material to effect the infiltration of the molten material into the powdered metal part. Since only a local area of the powdered metal part is heated, infiltration will be limited to that locally heated area 16 as indicated by the dotted area 26.

The most common infiltrant material is copper, but any other suitable material useful for the purpose of effecting infiltration of powdered metal parts may be utilized in place of copper. As known in the powdered metal art, powdered metal behaves like a sponge with respect to the application of molten metal thereon. In the present invention, this behavior is utilized, but only in a localized area under the influence of localized heating.

Figure 2:
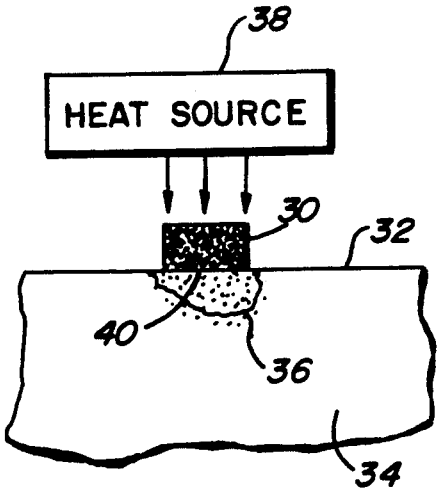
FIG. 2 is a fragmentary schematic illustration of the application of concentration heat upon an infiltrant material applied to only a single surface of a part.
Figure 3:
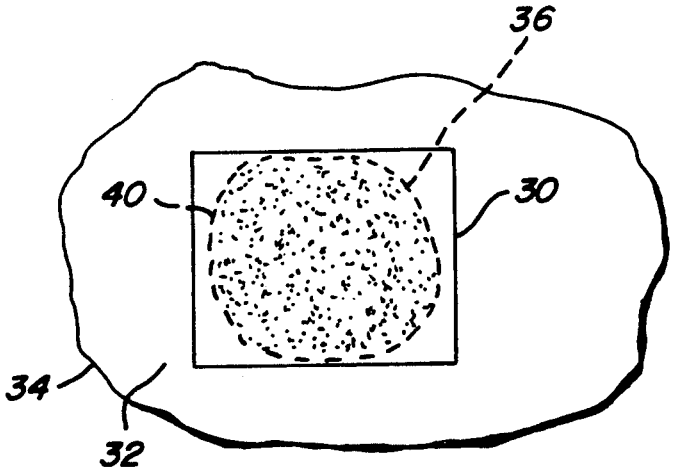
FIG. 3 is a fragmentary plan view of the infiltrant and part surface as shown in FIG. 2.

In the application illustrated in FIGS. 2 and 3, a quantity of infiltrant material 30 is applied to only one surface 32 of a powdered metal part 34. The positioning or application of the material 3 is adjacent a localized area 36, which requires improvement of its mechanical properties due to stress concentration. A heat source 38 is arranged to concentrate heat directly upon the material 30 to produce infiltration of molten material as indicated by the dotted area 40.

Figure 4:
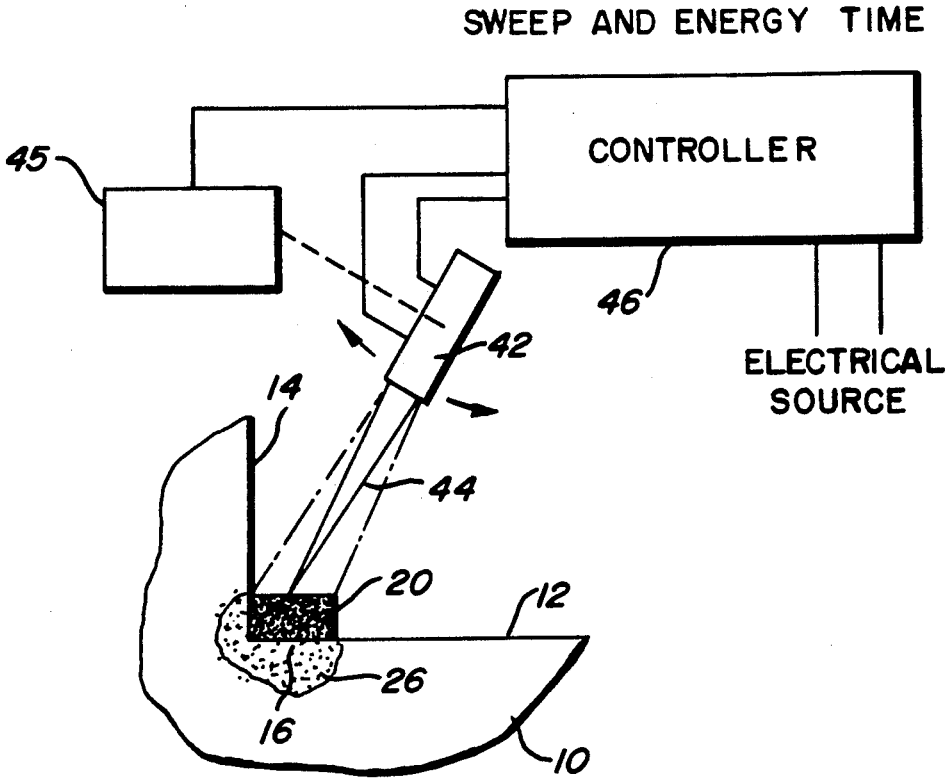
FIG. 4 is a fragmentary schematic illustration of the use of a laser beam and controller therefor for use as a heat source.

In the embodiment in FIG. 4, a heat source 42, in the form of a laser device devised to produce a laser beam in the form of a light ray 44, is arranged to direct the same in a sweeping action upon the entire area of the material 20, as indicated by the dotted lines for the beam 44. The laser device 42 is operatively associated with a suitable mechanism 45 devised for imposing this sweeping action. A controller 46 is connected to the device 42 and mechanism 45 and is adapted to produce and control the intensity of the beam 44, the time in which the beam is applied to the material 20, and the amplitude and period of the sweeping action of the device 42 relative to the localized area and the material 20. In this manner, the volume of infiltration, that is, the depth under the area 16 is under control by the controller 46.

Figure 5:
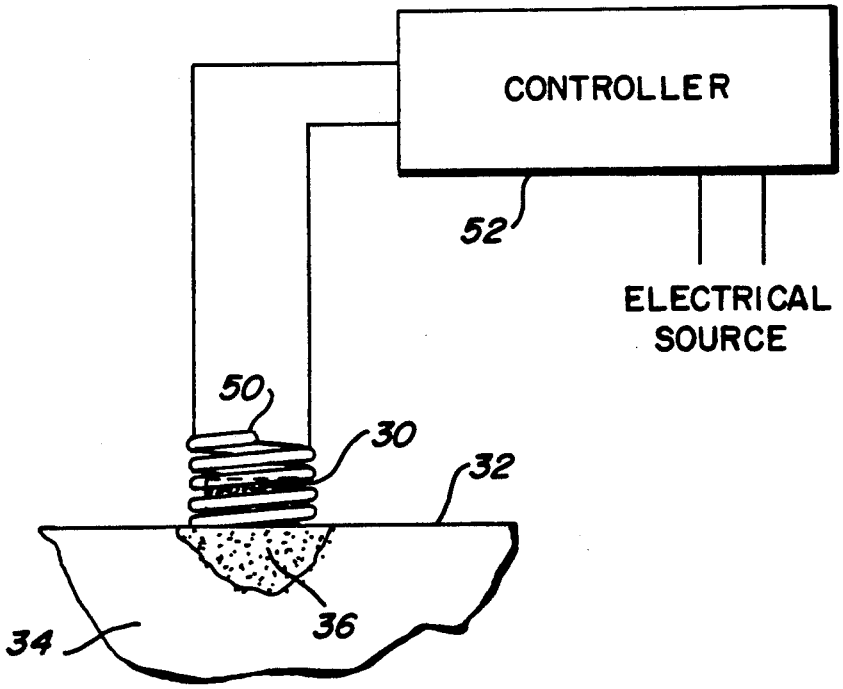
FIG. 5 is a fragmentary schematic illustration showing the use of an induction coil and controller therefor for producing melting of an infiltrant material.

In the embodiment of FIG. 5, the part 34, having the material 30 applied thereto, has its localized area of stress concentration 36 and the material 32, heated by an induction coil 50 operatively connected to a controller 52. In this arrangement, the volume of infiltration, that is, area and depth of how much of the material 20 is adapted to infiltrate, is controlled by the amount of current through the coil 50 and the time such coil is energized. The size and shape of the coil 50 is also determinable in accordance with the positioning and shape of the area affected, the size of the area, and desired depth of infiltration thereat.

From the foregoing, it will be appreciated that the present invention is adapted to achieve the objects of the invention as enumerated above by applying concentrated heat solely upon the infiltrant material and the localized area of a part which requires improvement in material properties. While the sources of heat have been described as including a laser device or an induction coil, it will be understood that other sources of concentrated heat may be utilized to produce localized heating upon a localized area of the part.

While preferred embodiments of the various aspects of the invention have been described using specific terms and arrangements, such descriptions are for illustrative purposes only, and it is to be understood that changes and variations may be made without departing from the scope of the following claims.

What is claimed is:

1. A method for improving the material properties of a powdered metal part having a localized area affected with stress concentration, comprising applying a metallic material adjacent the localized area to be affected, and applying heat in concentrated form from a heat source solely upon said metallic material and localized area in an amount to melt the material and produce infiltration of said metallic material into the powdered metal part solely at the localized area.

2. The method as defined in claim 1 wherein said heat source includes a laser beam.

3. The method as defined in claim 1 wherein said heat source includes an induction coil.

4. The method as defined in claim 1 wherein said metallic material is copper.

5. The method defined in claim 2, said step of applying heat includes the step of sweeping said laser beam across the localized area and said metallic material.

6. The method defined in claim 3 wherein said step of applying heat includes the step of positioning said induction coil adjacent said metallic material.

7. The method defined in claim 5 wherein said step of applying heat includes the step of controlling the amount of time of application and the sweeping action of said laser beam.

8. A method for improving the material properties of a powdered metal part having a localized area with impaired material properties, comprising applying a metallic material adjacent the localized area to be affected, and applying heat in concentrated form from a heat source solely upon said metallic material and localized area in an amount to melt the material and produce infiltration of said metallic material into the powdered metal part solely at the localized area.

9. The method as defined in claim 8 wherein said heat source includes a laser beam.

10. The method as defined in claim 8 wherein said heat source includes an induction coil.

11. The method defined in claim 9, said step of applying heat includes the step of sweeping said laser beam across the localized area and said metallic material.

12. The method defined in claim 10 wherein said step of applying heat includes the step of positioning said induction coil adjacent said metallic material.

13. The method defined in claim 11 wherein said step of applying heat includes the step of controlling the amount of time of application and the sweeping action of said laser beam.

14. A method for improving the material properties of a localized area of a powdered metal part by producing the infiltration of a metallic material into that area, comprising applying a metallic material adjacent the localized area to be affected, and applying heat in concentrated form from a heat source solely upon said metallic material and localized area in an amount to melt the material and produce infiltration of said metallic material into the powdered metal part at the localized area.

15. The method as defined in claim 14 wherein said heat source includes a laser beam.

16. The method as defined in claim 14 wherein said heat source includes an induction coil.

* * * * *